US008806685B2

(12) United States Patent
Karlson

(10) Patent No.: US 8,806,685 B2
(45) **Date of Patent: *Aug. 19, 2014**

(54) AXILLARY SUPPORT DEVICE

(71) Applicant: Axillan Corporation, Dover, MA (US)

(72) Inventor: James Karlson, Wayland, MA (US)

(73) Assignee: Axillan Corporation, Dover, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/919,481

(22) Filed: Jun. 17, 2013

(65) Prior Publication Data

US 2013/0283532 A1 Oct. 31, 2013

Related U.S. Application Data

(60) Continuation of application No. 13/625,479, filed on Sep. 24, 2012, now Pat. No. 8,484,783, which is a division of application No. 12/387,997, filed on May 11, 2009, now Pat. No. 8,291,534.

(51) Int. Cl.
*A62B 9/06* (2006.01)

(52) U.S. Cl.
USPC ..... 5/646; 5/632; 5/655.9

(58) Field of Classification Search
USPC ..... 5/632, 636, 646, 648, 652, 655.3, 5/655.9, 630, 645, 644
See application file for complete search history.

(56) References Cited

U.S. PATENT DOCUMENTS

| | | | |
|---|---|---|---|
| 1,045,228 | A | 11/1912 | Weltmer |
| 4,074,376 | A | 2/1978 | Bond |
| D254,029 | S | 1/1980 | Barbagallo |
| 4,805,603 | A | 2/1989 | Cumberland |
| 5,070,865 | A | 12/1991 | Iams |
| 5,224,226 | A | 7/1993 | Groenewald |
| 5,431,618 | A | 7/1995 | Levi |
| 5,479,667 | A | 1/1996 | Nelson et al. |
| 5,630,239 | A | 5/1997 | Franzen, Jr. |
| 5,644,809 | A | 7/1997 | Olson |
| 5,713,841 | A | 2/1998 | Graham |
| 5,815,862 | A | 10/1998 | Rygiel |

(Continued)

OTHER PUBLICATIONS

Arizona Burn Center at Maricopa Medical Center, "Airplane Splint/Abduction Pillow," [online] (2005) [retrieved on Dec. 15, 2008]. Retrieved from Internet URL: http://www.azburncenter.com/rehabilitation/airplanesplint.

(Continued)

*Primary Examiner* — William Kelleher
(74) *Attorney, Agent, or Firm* — Hamilton, Brook, Smith & Reynolds, P.C.

(57) ABSTRACT

An axillary support device is provided for decompressing the axilla (armpit) and associated structures in a sidelying position. A thoracic cushion provides firm axillary support to a user at the level of the mid to upper thorax, distal to the axilla. A head cushion connected to the thoracic cushion supports the user's head and may maintain a neutral cervical spine alignment position. A connector connecting the cushions creates a valley to receive an upper arm of the user. A back support may be used to maintain the sidelying position. An inflatable bladder may be used to adjust the axillary support device in order to appropriately relieve pressure on the user's axilla and associated structures. With the axillary support device, the upper arm of the user is relatively free to extend perpendicularly in front of the body in the sidelying position with reduced stress on the lateral shoulder and axilla.

21 Claims, 4 Drawing Sheets

(56) References Cited

U.S. PATENT DOCUMENTS

| | | | | |
|---|---|---|---|---|
| D404,238 | S | 1/1999 | Keilhauer | |
| 5,906,205 | A | 5/1999 | Hiebert | |
| 5,987,675 | A | 11/1999 | Kim | |
| 5,996,583 | A | 12/1999 | King | |
| 5,997,491 | A | 12/1999 | Harris | |
| 6,052,847 | A | 4/2000 | Allyn et al. | |
| 6,185,768 | B1 | 2/2001 | Schlechter | |
| 6,292,964 | B1 | 9/2001 | Rose et al. | |
| 6,360,387 | B1 | 3/2002 | Everhart | |
| 6,902,537 | B1 | 6/2005 | Geisert | |
| 7,316,707 | B2 | 1/2008 | Kalina et al. | |
| 7,634,829 | B1 | 12/2009 | La Bar | |
| 8,065,766 | B1 * | 11/2011 | Fierro | 5/632 |
| 8,291,534 | B2 | 10/2012 | Karlson | |
| 8,484,783 | B2 | 7/2013 | Karlson | |
| 2007/0039102 | A1 | 2/2007 | Thompson | |
| 2009/0222989 | A1 | 9/2009 | Dennewald | |

OTHER PUBLICATIONS

Della Valle, A. G., et al., "Inflatable Pillows as Axillary Support Devices During Surgery Performed in the Lateral Decubitus Position Under Epidural Anesthesia," *Anesth Analg*, 93: 1338-1343 (2001).

Tempur-Pedic, "Travel NeckPillow by Tempur-Pedic Providing Neck Support and Comfort," [online] [retrieved on Dec. 2, 2010]. Retrieved from Internet URL: http://www.tempurpedic.com/Travel-Pillows/Tempur-Pedic-NeckPillow-Travel.asp.

* cited by examiner

AXILLARY SUPPORT DEVICE

RELATED APPLICATIONS

This application is a continuation of U.S. application Ser. No. 13/625,479, filed Sep. 24, 2012, which is a divisional of U.S. application Ser. No. 12/387,997, filed May 11, 2009, now U.S. Pat. No. 8,291,534.

The entire teachings of the above applications are incorporated herein by reference.

BACKGROUND OF THE INVENTION

Positioning on one's side while sleeping, resting, or under anesthesia causes increased pressure on the shoulder and axillary structures (i.e., structures associated with an armpit) which, in turn, may cause injury to these structures, resulting in shoulder pain, arm pain, or radiating nerve pain. People with shoulder or neurologic disorders who try to sleep in a sidelying (lateral) position commonly awaken with shoulder pain and/or numbness or tingling of the hand or arm. Such symptoms may cause significantly altered sleep patterns and result in other health problems.

SUMMARY OF THE INVENTION

An axillary support device having a head cushion, a thoracic cushion, and a connector is provided. The thoracic cushion is configured to support the thorax of the user and relieve pressure on an axilla (armpit) of the user in a sidelying position. The connector connects the head cushion to the thoracic cushion, creating a valley between the head cushion and the thoracic cushion. The valley is configured to receive an upper arm of the user.

The head cushion, the thoracic cushion, and the connector may be formed as a unitary structure.

The axillary support device may also have a back support at a side of the axillary support device. The back support is configured to maintain the user in the sidelying position.

The head cushion or the thoracic cushion, or both, may be filled with a fluid.

An inflatable bladder may be provided in at least one of the head cushion and the thoracic cushion to enable adjustment of the volume of the fluid.

The head cushion and/or the thoracic cushion may be formed from a compressible foam-like material.

The thoracic cushion may have an uncompressed height between about 10 cm and about 16 cm. A distance of between about 23 cm and about 31 cm, or between about 25 cm and about 29 cm, may separate a lower end of the head cushion and a top part of the thoracic cushion. The head cushion may have an uncompressed height between about 16 cm and about 24 cm. The uncompressed heights of the head cushion and of the thoracic cushion may be about 2.5 times greater than their respective compressed heights.

The thoracic cushion may have an uncompressed height between about 12 cm and about 14 cm. The head cushion may have an uncompressed height between about 18 cm and about 22 cm.

In certain embodiments, the head cushion has an uncompressed height of about 20 cm, the thoracic cushion has an uncompressed height of about 13 cm, and a distance of about 27 cm separates a lower end of the head cushion and a top part of the thoracic cushion.

A method of decompressing an axilla of a user in a sidelying position is provided. A head cushion and a thoracic cushion are provided, with the head cushion connected to the thoracic cushion by a connector that creates a valley between the head cushion and the thoracic cushion. The head of the user is supported with the head cushion, and the thorax of the user is supported with the thoracic cushion with sufficient pressure to decompress the axilla.

The method may further include receiving an upper arm of the user in the valley to reduce stress on the axilla.

The method may further include adjusting a volume of fluid in at least one of the cushions to accommodate the user.

The method may further include supporting the back of the user to maintain the sidelying position of the user.

Supporting the head may maintain a neutral alignment of the cervical spine of the user.

The method may further include raising the lateral chest of the user to a height approximately equal to the diameter of an upper arm of the user.

The head cushion may be positioned at a distance from the thoracic cushion approximately equal to the diameter of the upper arm plus the length of the neck of the user.

An axillary support device is provided having a head cushion, a thoracic cushion, and a connector that connects the head cushion to the thoracic cushion. The head cushion is configured to support the head of a user in a neutral cervical spine alignment. The head cushion has an uncompressed height between about 18 cm and about 22 cm and a compressed height between about 7 cm and about 9 cm. The thoracic cushion is configured to support the thorax of the user and relieve pressure on an axilla of the user in a sidelying position. The thoracic cushion has an uncompressed height between about 12 cm and about 14 cm and a compressed height between about 4 cm and about 6 cm. A distance of between about 25 cm and about 29 cm separates a lower end of the head cushion and a top part of the thoracic cushion. The connector creates a valley between the head cushion and the thoracic cushion. The valley is configured to receive an upper arm of the user.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Embodiments of the present invention relieve pressure on the shoulder and axillary neurovascular structures while in a sidelying position (as during sleep, resting while awake, or under general anesthesia), thereby avoiding injuries to these structures. Specifically, pressure is relieved from the rotator cuff, acromioclavicular (AC) joint, glenohumeral joint, brachial plexus, and associated nerves and axillary vessels of a user. Optimally used, pressure from the upper body will pass from the head to the thorax, bypassing the shoulder. In other words, embodiments support the thorax and thereby decompress the shoulder and axilla (i.e., part of the human body associated with an armpit).

In the prior art, there is no support structure available that allows lateral positioning (sidelying) that does not cause direct pressure on the lateral shoulder that, in turn, causes direct pressure on the shoulder and neurovascular structures in the axilla of the individual. Embodiments of the present invention provide axillary support to allow comfortable sleep to people afflicted with many shoulder/upper extremity conditions. A neutral position of the cervical spine is also maintained while in a sidelying position, thereby reducing the chance of injury to the cervical spine and associated cervical nerves.

Figure 1A:
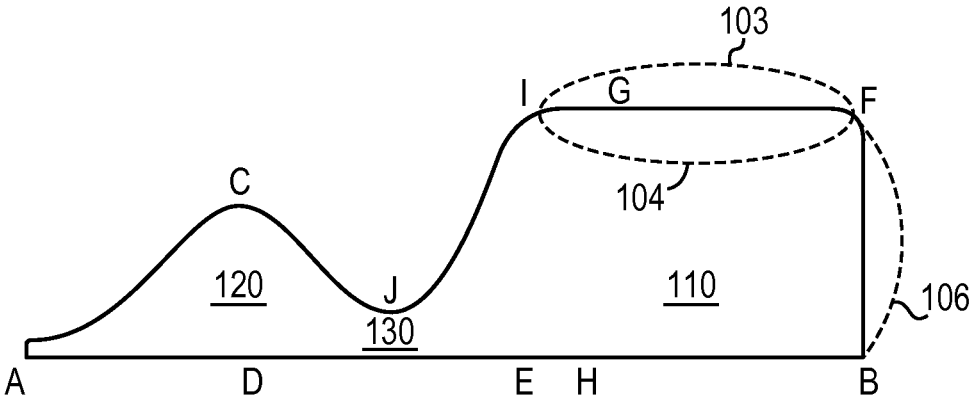
FIG. 1A is a side view of an axillary support device.
Figure 1B:
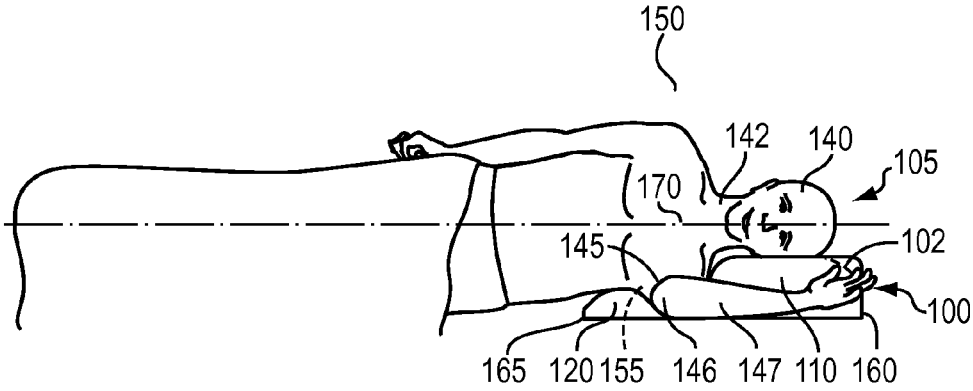
FIG. 1B is a side view of an individual (user) using an axillary support device on the individual's left side.
Figure 1C:
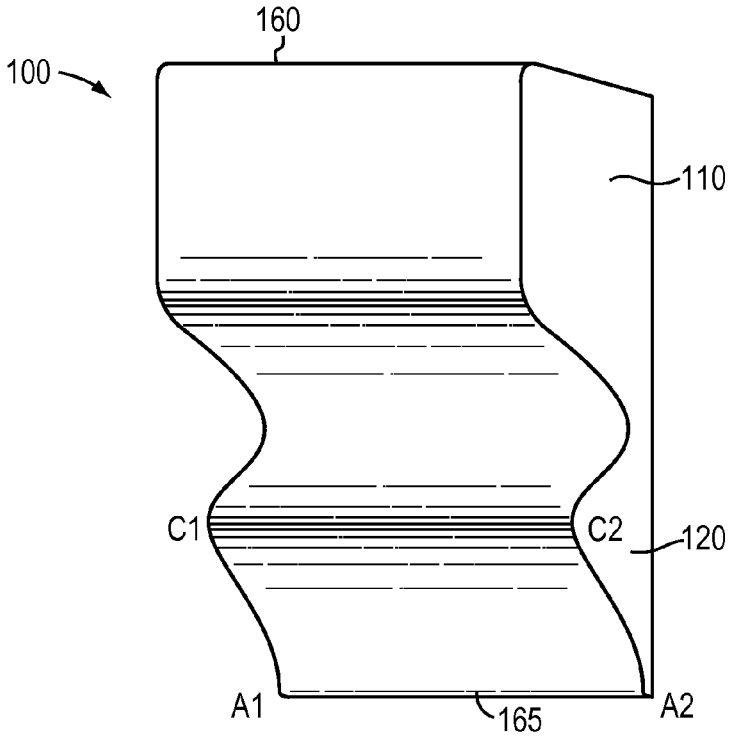
FIG. 1C is a top perspective view of the axillary support device of FIG. 1A.
Figure 1D:
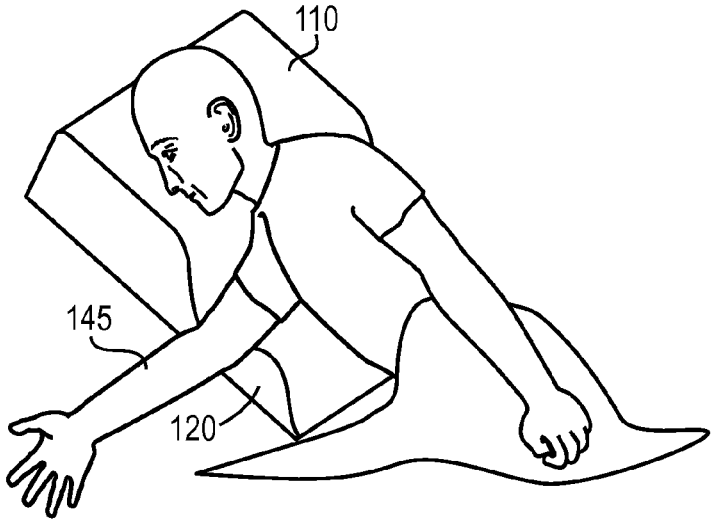
FIG. 1D is a side perspective view of an individual using the axillary support device of FIG. 1A on the individual's right side.

Medical conditions that embodiments of the present invention treat include:

Rotator cuff syndrome
Rotator cuff tear
Impingement syndrome
AC joint arthritis
Brachial plexopathy
Thoracic outlet syndrome
Ulnar neuritis
Median neuritis
Post-operative shoulder surgery
Cervical spondylosis with or without radiculopathy FIGS. 1A-B are side views of an axillary support device in an embodiment of the invention, in isolation and in use, respectively. FIGS. 1C-D are top perspective and side perspective views, respectively, of an axillary support device. FIGS. 1B and 1D show a user lying on his/her left side and right side, respectively.

An axillary support device 100 with an upper end 160 and a lower end 165 includes a head cushion 110 near the upper end 160 and a thoracic cushion 120 at the level of the mid to upper thorax 150 of a user 105, who may be an adult male or female. The thoracic cushion 120 is distal to the axilla 155, where distal means away from the user's head, i.e., towards the lower body. The thoracic cushion 120 is firm enough to raise the lateral chest (the part of the thorax 150 contacting the thoracic cushion 120) a distance approximately equal to the diameter of an upper arm 145 of the user 105.

The thoracic cushion 120 is shown in FIG. 1B to taper off gradually at the lower end 165. In other embodiments, the part of the thoracic cushion 120 near the lower end 165 of the axillary support device 100 may have different shapes (e.g., may curve more steeply or roll off, may be straight, or may fall off abruptly, among other possibilities). Similarly, the upper end 160 of the head cushion 100 is shown in FIG. 1B to be relatively flat in a vertical direction; in other embodiments, the shape of upper end 160 differs, e.g., as shown by shape 106. The surface of the head cushion 110 contacting the head 140 is shown as relatively flat in FIG. 1B. However, the shape of the head cushion 110 may vary, and the head cushion 110 may be convex 103 or concave 104.

The support region of the head cushion 110 is at a distance approximately equal to the diameter of the upper arm 145 plus the length of the neck 142 from the thoracic cushion 120; this distance corresponds to the distance between points D and H in FIG. 1A. The support region begins at point G in FIG. 1A and extends towards point F. In some embodiments, the head cushion 110 has a height (distance between points F and B) which supports the head 140 of the user 105 in a neutral cervical spine alignment 170.

FIG. 1B shows the user's left upper arm 145 extended out of the page, perpendicular to the body. The upper arm 145 is relatively free to extend perpendicular to and in front of the body, with no undue stress on the lateral shoulder 143 or axilla 155. In other embodiments, the upper arm 145 extends outwardly at an angle less than 90 degrees with respect to the body. In some embodiments, the user's arm is free to bend at the elbow 146; FIG. 1B shows such a configuration with the forearm 147 parallel to the user's body and the user's palm facing upwards.

The distance between points A and B is preferably between 65 cm and 95 cm, more preferably between 70 cm and 90 cm, and most preferably about 80 cm. This distance, referred to as the length of the axillary support device 100, accommodates a typical adult human, and other lengths may be used to accommodate others (e.g., children or especially tall individuals). The distance between points A1 and A2 is preferably between 60 cm and 90 cm, more preferably between 70 cm and 83 cm, and most preferably about 75 cm. This distance is referred to as the width of the axillary support device 100) and may be different than the length. FIG. 1C shows a ridge or hump extending across the width of the axillary support device between points C1 and C2. In some embodiments (not shown), the ridge is flattened out or vanishes entirely at a central location along the width of the axillary support device 100 to enable the user to lie on his/her back comfortably (e.g., before rolling over to the other side of the body).

The axillary support device 100 is shown in FIG. 1A in a preferred embodiment combining a head cushion 110, a thoracic cushion 120, and a connector formed as a unitary structure, i.e., in one piece comprising a single material. Providing the axillary support device 100 as a single unit simplifies usage for the user, e.g., for convenience and portability. Furthermore, having the axillary support device 100 as a single unit, in which the head cushion 110 is joined to the thoracic cushion 120 by a connector that creates a valley between the respective cushions, reduces the chance of improper usage by the user e.g., due to not knowing the correct orientation in which to place one's body relative to the cushions. Users without medical training who attempt to relieve axillary pressure manually using techniques other than embodiments of the present invention may injure themselves or aggravate existing injuries due to improper anatomical orientation. For example, users without medical training who attempt to build their own homemade devices might not decompress the right anatomical structures or might use medically unsound dimensions for their devices. The single-unit configuration of the axillary support device 100 ensures that a user can reliably and repeatably receive relief from undue stress on the axilla and associated structures to the user's benefit.

The purpose of the connector 130 is to maintain a connection between the head cushion 110 and the thoracic cushion 120. The top of the connector 130 (point J in FIG. 1A) should be as low as possible relative to the base of the axillary support device 100 (e.g., the line connecting points A and B in FIG. 1A) in order to accommodate the user's arm in the correct orientation to relieve pressure on the axilla. Having point J too high would cause pressure on the axilla to be insufficiently relieved, since the valley between the cushions would not provide enough space to receive the upper arm 145. If the axillary support device 100 is a unitary structure, the top of the connector 130 may be between about 2 cm and about 4 cm (preferably about 3 cm) above the base of the axillary support device 100. If the connector 130 is made of a compressible material, the 3 cm height may correspond to an uncompressed height. If the height of the connector 130 is much less than 2 cm in the case of a unitary structure, the connector 130 might tear or break off from at least one of the cushions, resulting in the separation of the head cushion 110 and the thoracic cushion 120.

In another embodiment, the connector 130 is a separate piece from the head cushion 110 and/or the thoracic cushion 120. The connector 130 may be attached to the head cushion 110 and the thoracic cushion by conventional attachment means. The connector 130 may be a cloth or a material with rigidity. If the connector 130 is a separate piece from the head cushion 110 and/or the thoracic cushion 120, the connector may have negligible height relative to the base of the axillary support device 100, e.g., in the case of a cloth connector. In some embodiments, the connector 130 may be detached from the head pillow to enable customization by enabling the user to use his/her preferred pillow under the head.

The axillary support device 100 may be formed from a foam-like material (e.g., foam) that provides softness for comfort and is sufficiently stiff to provide support for the head 105 and thorax 150. In some embodiments, the thoracic cushion 120 provides more stiffness than the head cushion 110. In other embodiments, separate cushions may be connected via the connector 130. In some embodiments, at least one of the head cushion 110 and the thoracic cushion 120 has internal fill, as is conventionally used in pillows.

The foam-like material of the axillary support device 100 is compressible in some embodiments to provide comfort as well as support to the user 105. The axillary support device may have a compressibility ratio of about 2.5, i.e., providing uncompressed heights for the head cushion 110 and the thoracic cushion 120 that are about 2.5 times greater than the respective compressed heights. The head cushion 110 may have an uncompressed height (distance between points B and F) preferably between about 16 cm and about 24 cm, more preferably between about 18 cm and about 22 cm, and most preferably about 20 cm. The head cushion 110 may have a compressed height between about 6 cm and about 10 cm, more preferably between about 7 cm and about 9 cm, and most preferably about 8 cm. The thoracic cushion 120 may have an uncompressed height between about 10 cm and about 16 cm, more preferably between about 12 cm and about 14 cm, and most preferably about 13 cm. The thoracic cushion 120 may have a compressed height between about 3 cm and about 7 cm, more preferably between about 4 cm and about 6 cm, and most preferably about 5 cm.

In some embodiments, a greater compressibility ratio is provided for the head cushion 110 than for the thoracic cushion 120, e.g., to provide increased stiffness with the thoracic cushion 120.

Figure 2:
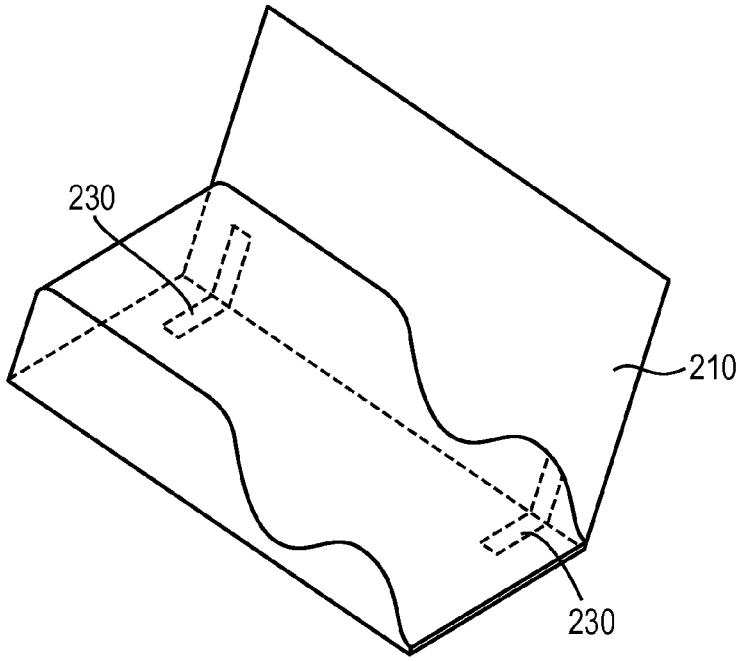
FIG. 2 is a perspective view of an axillary support device with a back support.

FIG. 2 is a perspective view of an axillary support device with a back support 210. The back support 210 may be a foam-like side support cushion which can be placed at either end of the pillow to restrict rolling from a side position to a supine position (i.e., on one's back). The purpose of this is to maintain either a right or a left sidelying position. Alternatively, the back support 210 may include a material without foam-like properties, e.g., a hard board or other support. Without the back support 210, which may be detached, the person may freely roll from one side to the other, utilizing either a right or left sidelying position. By preventing the user 105 from rolling into a supine position, use of the back support 210 may alleviate snoring and other conditions associated with lying on one's back.

In the embodiment shown in FIG. 2, the back support 210 is a unit separate from the main part of the axillary support device 100 including the head cushion 110 and the thoracic cushion 120, and the back support is joined using brackets 230. Two brackets 230 are shown, although other numbers may be used. The bracket(s) 230 may be metal or non-metal brackets as is known in the art. Other conventional means of fastening may be used as well in place of brackets. In other embodiments (not shown), the back support 210 is formed from the same piece of material (e.g., foam or other foam-like material) as the rest of the axillary support device 100 and projects upwardly or at an angle (either in a curved or linear manner) to maintain the sidelying position of the user 105.

The embodiment shown in FIG. 2 corresponds to a right sidelying position (i.e., the user 105 lying on the right side) and prevents the user 105 from rolling onto the user's back. In another embodiment (not shown), the back support 210 is designed for a left sidelying position. Alternatively, the back support 210 may be attachable to either side with the brackets 230.

Figure 3:
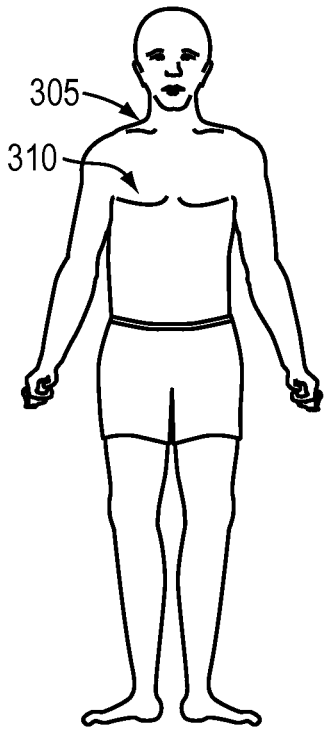
FIG. 3 is a diagram of the human body showing locations relevant to the dimensions of an embodiment of the invention.

FIG. 3 is a diagram of the human body showing locations relevant to the dimensions of an embodiment of the invention. The trapezius landmark 305 at the right side of the neck and the the lion landmark 310 (corresponding to the right nipple for men) are shown in FIG. 3. The dimensions of the axillary support device 100 are based on the distance between these landmarks, as derived from anthropometric data (Donelson, S. and Gordon, C., 1995 *Matched Anthropometric Database of U.S. Marine Corps Personnel: Summary Statistics*, September 1996. The the lion landmark 310 corresponds approximately to point C in FIG. 1A, i.e., the top part of the thoracic cushion 120. The trapezius landmark 305 corresponds approximately to point I in FIG. 1A, i.e., the lower end of the head cushion 110 (the end of the head cushion 110 towards the lower end 165 of the axillary support device 100). According to the anthropometric data of Donelson and Gordon, $5^{th}$ to $95^{th}$ percentile values for the distance between the trapezius landmark 305 and the the lion landmark 310 are 23.5 to 30.5 cm. In embodiments of the invention, the distance between points C and I is preferably between about 23 cm to about 31 cm, more preferably between about 25 cm and 29 cm, and most preferably about 27 cm.

Figure 4:
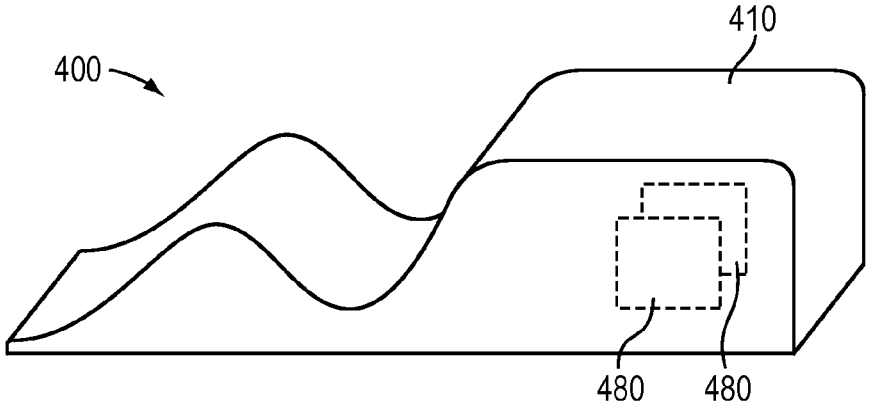
FIG. 4 is a perspective view of an axillary support device with baffles in an embodiment of the invention.

FIG. 4 is a perspective view of an axillary support device 400 with baffles in an embodiment of the invention. Baffles are commonly used to provide structure to pillows and to maintain the position of internal fill during compression. For example, U.S. Pat. No. 7,467,432 teaches details of baffles in pillows. Baffles may reduce the chance of internal fill being displaced to the sides of a pillow when a person places his head on the pillow. In the example configuration shown in FIG. 4, two baffle members 480 are used in a parallel arrangement in the head cushion 410. Other arrangements (e.g., curved baffle members) may be used, and different numbers of baffle members (including a single baffle member) may be used as well, as is known to a person of ordinary skill in the art.

Figure 5:
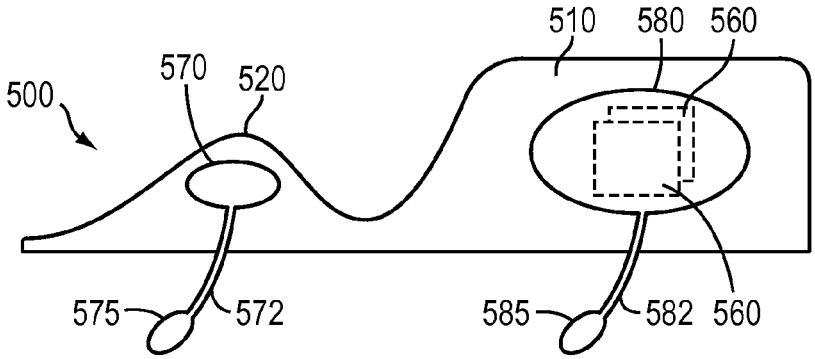
FIG. 5 is a side view of an axillary support device with inflatable bladders in cushions in an embodiment of the invention.

FIG. 5 is a side view of an axillary support device 500 with inflatable bladders in an embodiment of the invention. Using an inflatable bladder 570 in the thoracic cushion 520 and an inflatable bladder 580 in the head cushion 510 enables customization of the axillary support device 500. For example, the user may adjust the volume in the cushion(s) to his/her desired level for comfort or to accommodate the body in a particular spatial configuration, as discussed further below. In an embodiment, the inflatable bladder 580 in the head cushion 510 may be deflated to enable the user to use his/her preferred pillow, instead of the head cushion 110, to support the head.

In some embodiments, only one of the cushions has a bladder. In other embodiments, the inflatable bladders 570, 580 may be inflated to different volumes. FIG. 5 shows an example in which inflatable bladder 580 may be inflated to a larger volume than inflatable bladder 570. The inflatable bladder 570 and/or the inflatable bladder 580 may be filled with a fluid (not shown). The fluid may be air, another gas, a liquid, or a gel. The fluid may be pumped (or otherwise transported) in or out of the bladders to adjust bladder volume. Other types of fill than a fluid may also be used to adjust volume. Using a fluid enables softness adjustment in some embodiments.

In the case of the fluid being air or another gas, the inflatable bladder 570 may be inflated and/or deflated using an inflation bulb 575 and an inflation tube 572 connected to the inflatable bladder 570 according to conventional techniques known to one of ordinary skill in the art, which may include valves and/or valve stems in the inflatable bladder 570. For example, U.S. Pat. No. 5,630,651 teaches techniques of using an inflatable bladder for a pillow, including details associated with constructing a bladder, and U.S. Pat. No. 5,906,205 teaches evacuating air from a bladder. The use of an inflatable bladder enables adjustment of the volume and pressure associated with the inflatable bladder 570. Inflating the inflatable bladder 570 raises the top of the thoracic cushion 520 (point C in FIG. 1B) to a height approximately equal to the diameter of the upper arm, thereby decompressing the axilla 155.

Similarly, the inflatable bladder 580 may be inflated and/or deflated using an inflation bulb 585 and an inflation tube 582 in order to achieve a desired height of the head cushion 510, e.g., a height that maintains a neutral position of the cervical spine when in a sidelying position. Maintaining a neutral cervical spinal alignment reduces the chance of injury to the cervical spine and associated cervical nerves.

In some embodiments, multiple inflation bulbs and/or inflation tubes are associated with each of the inflatable bladders.

In some embodiments, as shown in FIG. 5, at least one of the inflatable bladders 570, 580 includes baffles to confine a fluid (e.g., air) to a portion of the bladder. FIG. 5 shows an example in which the inflatable bladder 580 in the head cushion 510 includes two baffles 560 to compartmentalize the bladder; other numbers of baffles may be used as well. In other embodiments, baffles are not present in the bladders. With one or more baffles in an inflatable bladder, the cushion having the bladder provides uniform elevation when pressure is applied, and compressing one end of the bladder does not displace the fluid within the bladder to the other end. Similarly, with one or more baffles, compressing the middle of the bladder does not displace the fluid within the bladder to either end to an extent that rigidity might be decreased.

In certain embodiments, the bladders are inflatable once and have relatively constant volumes thereafter; in certain other embodiments, the bladders may be inflated and/or deflated by the user 105 or by others multiple times.

Embodiments of the invention have home and/or clinical uses. Home users may use embodiments of the invention for sidelying while awake or sleeping. Home users may even exercise in a sidelying position using embodiments of the invention. Clinical applications include maintaining patients in a sidelying position. For example, the axillary support device 100 may be used before, during, or after medical procedures (which may be related to the shoulder or unrelated) and for positioning under anesthesia (or not under anesthesia) to protect the axillary structures, e.g., by relieving pressure on the axilla and associated structures. Embodiments of the invention are portable for convenience.

While this invention has been particularly shown and described with references to example embodiments thereof, it will be understood by those skilled in the art that various changes in form and details may be made therein without departing from the scope of the invention encompassed by the appended claims.

For example, a cover dimensioned and shaped to enshroud the axillary support device 100 is provided in an embodiment of the invention.

What is claimed is:

1. An axillary support device comprising:

a head cushion having a width and a height configured to support the head of a sidelying user in a substantially neutral cervical spine alignment;

a thoracic cushion having a peak configured to be adjacent to the shoulder of the sidelying user with a height configured to support the thorax of the sidelying user at a height less than the height of the head cushion with sufficient pressure to decompress the axilla of the sidelying user; and a connector that connects the head cushion to the thoracic cushion, creating a valley between the head cushion and the thoracic cushion, the valley having a depth configured to receive the upper arm of the sidelying user with the thorax supported on the thoracic cushion to relieve pressure on the axilla of the user.

2. The axillary support device of claim 1, wherein the head cushion, the thoracic cushion, and the connector are formed as a unitary structure.

3. The axillary support device of claim 1, further including a back support at a side of the axillary support device, the back support configured to maintain the user in the sidelying position.

4. The axillary support device of claim 1, wherein at least one of the head cushion and the thoracic cushion is filled with a fluid.

5. The axillary support device of claim 4, further including an inflatable bladder in at least one of the head cushion and the thoracic cushion to enable adjustment of the volume of the fluid.

6. The axillary support device of claim 1, wherein at least one of the head cushion and the thoracic cushion is formed from a compressible material.

7. The axillary support device of claim 1, wherein the thoracic cushion has an uncompressed height between about 10 cm and about 16 cm.

8. The axillary support device of claim 7, wherein the head cushion has an uncompressed height between about 16 cm and about 24 cm.

9. The axillary support device of claim 8, wherein the uncompressed heights of the head cushion and of the thoracic cushion are about 2.5 times greater than their respective compressed heights.

10. The axillary support device of claim 7, wherein the head cushion has an uncompressed height between about 16 cm and about 24 cm.

11. The axillary support device of claim 7, wherein the uncompressed heights of the head cushion and of the thoracic cushion are about 2.5 times greater than their respective compressed heights.

12. The axillary support device of claim 1, wherein the thoracic cushion has an uncompressed height between about 12 cm and about 14 cm.

13. The axillary support device of claim 12, wherein the head cushion has an uncompressed height between about 18 cm and about 22 cm.

14. The axillary support device of claim 13, wherein the uncompressed heights of the head cushion and of the thoracic cushion are about 2.5 times greater than their respective compressed heights.

15. A method of decompressing an axilla of a user in a sidelying position, the method comprising:

providing a head cushion and a thoracic cushion as claimed in claim 1, the head cushion connected to the thoracic cushion by a connector that creates a valley between the head cushion and the thoracic cushion;

supporting the head of the user with the head cushion; and supporting the thorax of the user with the thoracic cushion with sufficient pressure to decompress the axilla.

16. The method of claim 15, further including receiving an upper arm of the user in the valley to reduce stress on the axilla.

17. The method of claim 15, further including adjusting a volume of fluid in at least one of the cushions to relieve pressure on the axilla and associated structures.

18. The method of claim 15, further including supporting the back of the user to maintain the sidelying position of the user.

19. The method of claim 15, wherein supporting the head maintains a neutral alignment of the cervical spine of the user.

20. The axillary support device of claim 8, wherein the thoracic cushion and the head cushion are substantially compressible.

21. The axillary support device of claim 13, wherein the thoracic cushion and the head cushion are substantially compressible.

* * * * *